United States Patent [19]

Sharp

[11] Patent Number: 4,773,311

[45] Date of Patent: Sep. 27, 1988

[54] MAKE UP AIR CONTROLLER FOR USE WITH FUME HOOD SYSTEMS

[75] Inventor: Gordon P. Sharp, Newton, Mass.

[73] Assignee: Phoenix Controls Corporation, Newton, Mass.

[21] Appl. No.: 933,965

[22] Filed: Nov. 24, 1986

[51] Int. Cl.[4] ..... B05B 15/02

[52] U.S. Cl. ..... 98/115.3; 98/33.1

[58] Field of Search ..... 98/33.1, 1.5, 115.1, 98/115.3; 126/299 R, 299 D

[56] References Cited

U.S. PATENT DOCUMENTS

| | | | |
|---|---|---|---|
| 3,745,908 | 7/1973 | Mayberry | 98/115.3 |
| 4,372,195 | 2/1983 | Dorius | 98/115.3 X |
| 4,483,316 | 11/1984 | Fritz et al. | 98/33.1 X |
| 4,528,898 | 7/1985 | Sharp et al. | 98/115.3 |

FOREIGN PATENT DOCUMENTS

| | | | |
|---|---|---|---|
| 1208863 | 1/1966 | Fed. Rep. of Germany | 98/115.3 |
| 2076145 | 11/1981 | United Kingdom | 98/115.3 |

*Primary Examiner*—Harold Joyce

*Attorney, Agent, or Firm*—Wolf, Greenfield & Sacks

[57] ABSTRACT

Method and apparatus for varying the make-up air volume of an HVAC system used in conjunction with a laboratory fume hood. The invention maintains a constant difference in air volume between the total air volume exhausted from the laboratory, including the variable fume hood exhaust volume and the make-up and supply air provided by the HVAC system. The invention provides a continuous modulation of the make-up air volume which tracks the exhaust volume to maintain a constant preset differential between the makeup and exhaust volumes. The invention includes a preferred embodiment in which a signal from a sash height transducer is used to control the volume of make-up air.

1 Claim, 2 Drawing Sheets

MAKE UP AIR CONTROLLER FOR USE WITH FUME HOOD SYSTEMS

FIELD OF THE INVENTION

This invention is related to fume hood systems, and more particularly to means for controlling make-up air supplied to a fume hood room by an HVAC system.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with a sash which typically slides up and down to vary the opening into the hood.

The velocity of the air flow through the hood opening is called the face velocity. The more hazardous the material being handled, the higher the recommended face velocity, and guidelines have been established relating face velocity to toxicity.

When an operator is working in the hood, the sash is opened to allow free access to the materials inside. The sash may be opened partially or fully, depending on the operations to be performed in the hood. While fume hood and sash sizes vary, the opening provided by a fully opened sash is typically on the order of ten square feet. Thus the maximum air flow which the blower must provide is typically on the order of 750 to 1500 cubic feet per minute (CFM).

The sash may be closed when the hood is not being used by an operator. It is common to store hazardous materials inside the hood when the hood is not in use, and a positive airflow must be maintained to exhaust contaminants from such materials even when the hood is not in use and the sash is closed.

Additionally, it is highly desirable to maintain the air pressure in a fume hood laboratory slightly negative with respect to adjoining corridors or rooms. This ensures that any fumes which may escape from a fume hood do not go beyond the fume hood laboratory. This is advantageous both for safety reasons and also to avoid the spread of fumes which although not dangerous may be unpleasant to smell or breath. When the laboratory is kept at a slightly lower pressure than the adjoining rooms, any air flow through cracks or through doors which may be opened as people go in and out will be into the fume hood laboratory.

Until recently, most fume hood systems have exhausted a relatively constant volume of air. To maintain a more constant face velocity as the hood sash is moved up and down, so-called "by-pass" hoods have been developed. A by-pass hood has a by-pass opening through which air can enter the fume hood. The by-pass opening is blocked by the sash when it is in the fully opened position. As the sash is lowered, the by-pass opening is gradually uncovered so that air can "by-pass" the hood opening and enter the hood directly, thus preventing he air velocity through the hood opening from becoming too high as the sash is closed.

In many modern buildings, the air exhausted by a fume hood must be supplied by the heating, ventilation, and air conditioning (HVAC) system. To maintain the desired negative pressure in the laboratory, the make-up air supplied by the HVAC system should be slightly less than the amount of air exhausted by the hood. In fume hood systems exhausting a substantially constant volume of air, this may be easily done by setting the make-up air volume to be slightly less than the sum of the fume hood exhaust air volume and the air removed and recirculated by the HVAC system.

During hot summer months and cold winter months, the costs associated with heating and cooling the air exhausted from the laboratory by the fume hood can be substantial. With the recent increases in the costs of energy, new methods of controlling the air exhausted by a fume hood have been developed which reduce the amounts of air exhausted. Additionally, more stringent safety regulations have put stricter requirements on the variation in face velocity which can be tolerated, and these requirements may be met by varying the total amount of air exhausted by the hood. An example of such a system is described in U.S. Pat. No. 4,528,898 for a Fume Hood Controller, and the material in this patent is incorporated by reference herein. Another example is described in U.S. Pat. No. 4,706,553 and incorporated by reference herein.

Fume hood control systems such as those described in the above-referenced patent and application result in variable amounts of air being exhausted from the laboratory. In buildings were the air must be supplied by the (HVAC) system, the volume of make-up air must vary as the fume hood exhaust air volume changes in order to maintain a negative pressure level in the fume hood laboratory One previous approach to this problem includes the use of a static pressure sensor to measure the difference between the laboratory pressure and the pressure in the adjoining corridor Make-up air is varied in response to the output from the sensor to maintain a constant pressure differential. There are several limitations to this procedure. First, it may be difficult to implement where the fume hood room opens into several different parts of the building. Typically, the pressure differentials between several rooms varies as the HVAC system increases and decreases air flow to different areas of the building. Maintaining a slightly negative pressure with respect to one adjoining room does not ensure that the laboratory pressure will always be negative with respect to the other rooms.

Additionally, the impedance or porosity between the laboratory and the adjoining corridor or rooms is a function of the area of the openings therebetween and may suddenly change by a large amount. For example a 100 cubic feet per minute (CFM) air flow into the laboratory may suddenly increase to 2000 CFM for a given pressure differential when a door is opened. This is undesirable. In addition to possibly creating annoying "breezes" through the door or other openings, the sudden increase in air flowing into the laboratory may tax the air supply into the corridor and may disturb the air balances of the HVAC system.

More importantly, it is difficult to ensure adequate performance in many installations due to the trade-off which must be made between the response time of the make-up air and the stability of the HVAC system. The air pressure differential which must be sensed is very small, typically on the order of 0.02 inches of water. Such small pressure differentials are difficult to sense and will contain a lot of "noise" caused by small variations in the pressure drops through the ducting and other parts of the HVAC system as the HVAC system changes air flows to various other parts of the building during normal operation. Long time lags and filters must typically be used to smooth out these variations. In some installations, large oscillations in air flows may result from changes in the system, such as when a door is opened, which in the worst case may become unstable, if such filtering is not used.

Another previous approach uses a switch located near the hood which selects between a low and high flow level. The switch may be operated manually or be activated by the movement of the hood sash. The make-up air supply also receives the signal from the switch and uses this signal to maintain a constant differential between the exhausted air and the make-up air. For example, if the hood exhaust volume may be switched between 500 CFM and 1,000 CFM, a damper controlling the make-up air volume would be switched between two positions corresponding to 300 CFM and 800 CFM. The maximum turndown ratio for such a system, however, is limited. Turndown ratios greater than two-to-one can produce variations in face velocity that may make the hood unsafe to use.

SUMMARY OF THE INVENTION

The present invention includes a novel way to vary the make-up air volume to maintain a constant difference in air volume between the total air volume exhausted from the laboratory, including the variable fume hood exhaust volume, and the make-up and supply air provided by an HVAC system. The invention generally reduces the make-up air volume required and accordingly reduces operating costs. The invention provides a continuous modulation of the make-up air volume which tracks the exhaust volume to maintain a constant, preset differential between the make-up and exhaust volumes. The present invention is especially suitable for use with exhaust hoods which vary the exhaust volume in accordance with the sash opening area.

Briefly, the present invention provides a signal from a sash height transducer that is representative of the sash opening area of a laboratory fume hood. This signal is appropriately scaled to represent the exhaust volume of the fume hood. An offset signal is subtracted from the scaled signal to generate a make-up air command signal The invention may also use as an input other signals from a fume hood controller which represent the fume hood exhaust volume. The make-up air command signal is used to drive a linear, pressure-independent make-up air control, such as a damper or blower.

If many hoods are located in one room, the make-up air commands from each hood can be scaled and summed to provide a combined make-up air command, which then would be applied to the make-up air controller. An emergency override mode may be used for evacuating the fume hood and laboratory in the event of a fire or other accident producing dangerous fumes. The override reduces the make-up air to it minimum value while exhausting the maximum amount of air from the fume hood or hoods. The invention may be integrated with an HVAC system which varies the volume of air supplied for heating and cooling the laboratory while still providing a predetermined volume differential between he air supplied and exhausted from the laboratory to maintain a negative (or positive) pressure differential between the laboratory and adjoining rooms.

The present invention may also be used to maintain a slight positive pressure in a fume hood laboratory. This is desirable in certain specialized situations, such as clean rooms, where it is desirable to prevent contaminants from entering the laboratory.

DESCRIPTION OF THE DRAWINGS

The operation and advantages of the present invention will become more apparent upon reading the following description of the preferred embodiment in conjunction with the accompanying figures, of which.

DESCRIPTION OF THE PREFERRED EMBODIMENT

Figure 1:
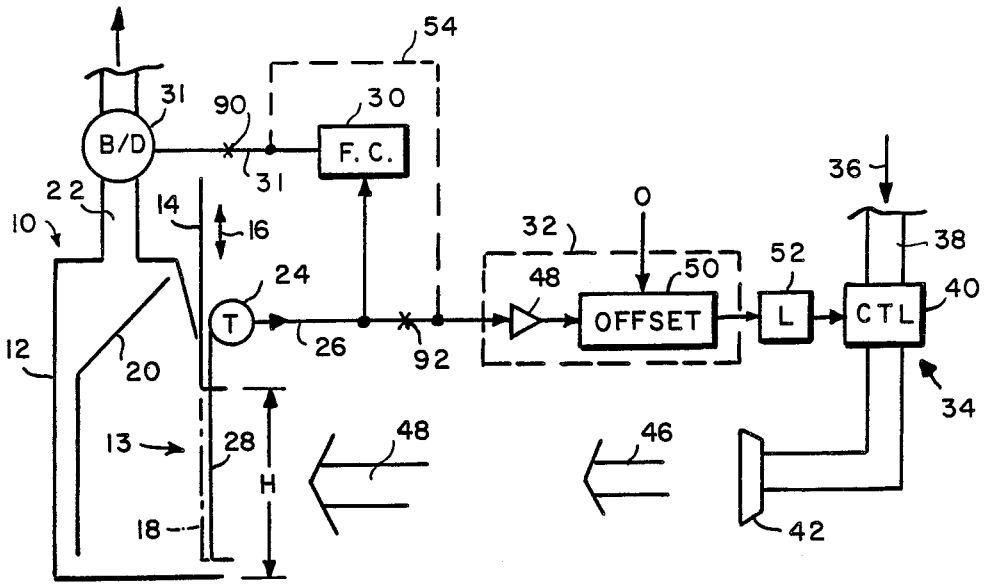
FIG. 1 is a block diagram showing the present invention used with a single fume hood system.

FIG. 1 shows one implementation of the present invention as it would be used with a single hood system. In FIG. 1, a fume hood 10 is includes a suitable enclosure 12 which has an opening 13 though which the operator manipulates the various items he or she is using in the hood. A movable sash 14 moves vertically, as shown by arrow 16, between an open position and a closed position, illustrated by dotted line 18. Typically, the hood will have one or more baffles 20 to provide further control of the air flow within the hood.

Air is exhausted through an exhaust opening and associated ducting 22 by a fan or blower. The blower may be located in close proximity to the hood or may be a long distance away, such as on the roof.

In the present invention, the position of the sash is monitored by a transducer 24 which provides an output signal on line 26 representative of the sash opening H, and therefore representative of the sash opening area. In the preferred embodiment, transducer 24 is implemented by means of a spring-return potentiometer which is connected to the sash 14 by a cable 28. As the sash is raised and lowered, cable 28 is wound and unwound on a reel connected to the wiper arm of the potentiometer so that the potentiometer resistance changes in accordance with the sash position to provide a sash opening signal on line 26.

In a fume hood system which continuously varies the air flow through the hood as the sash opening changes, the output from transducer 24 is applied to a flow controller 30. An output from flow controller 30 is applied to a blower or damper 31 for varying the air volume exhausted from the hood. The signal from the flow controller may be applied to the fume hood blower motor to control the blower speed. Alternatively, the signal may be applied to a damper which controls the flow through the hood by varying the resistance to air flow provided by the damper. In either case, the air flow is maintained substantially proportional to the sash opening as the sash is opened and closed so that the face velocity remains constant.

The previously referenced U.S. Patent and patent application describe in detail flow controllers for varying the hood exhaust air flow as the hood sash is raised and lowered. Other flow controllers may be used with the present invention, as will become apparent to those skilled in the art in reading the following description.

Make-up air for the fume hood room is supplied by the HVAC make-up air system, which is partially shown at 34 in FIG. 1. Air 36 is supplied by the HVAC system through ducting 38 and a control device such as damper 40 to one or more air supply vents 42 in the laboratory. The volume of make-up air, depicted by arrow 46 in FIG. 1 should be slightly less than the volume of air 48 being exhausted by the fume hood system if a negative air pressure is to be maintained in the laboratory. To do this, the sash opening signal on line 26 is also applied to make-up air controller circuitry 32, described below, for controlling the make-up air volume. The output signal from the make-up air control is applied to the make-up air control device 40 and varies the make-up air volume.

The above explanation ignores the volume of air recirculated or exhausted by the HVAC system, for simplicity in the explanation. Normally, HVAC systems provide heated or cooled supply air and unconditioned make-up air, and remove air in two ways: return air which is re-heated or cooled, and exhaust air which leaves the building and is replaced by fresh air for ventilation. Although for safety, HVAC systems for fume hood laboratories typically exhaust all the air from the room and do not recirculate any of the laboratory air, the present invention may be used with any combination of make-up, supply, exhaust, and return air sources. In any of these cases, the present invention is used to control the total supply and make-up air volume to maintain the volumetric balance between the total air into and out of the laboratory.

Make-up air control circuitry 32 includes a circuit 48 for scaling the output signal from the sash transducer. Typically, scaling circuit 48 is implemented by means of an amplifier whose gain is varied to scale the output from the transducer so that exhaust air flow signal from the amplifier matches the control function of control 40 in terms of CFM/volt.

The output from scaling circuit 48 is applied to an offset circuit 50. Offset circuit 50 adds a signal to the scaling circuit output which represents the desired difference between the fume hood exhaust volume 48 and the make-up air volume 46. The offset signal may be fixed or may be variable in response to an external input, exemplified by signal "0" in FIG. 1.

If the HVAC system has a make-up air command signal input, the output from make-up air controller 32 may be applied directly thereto. Most HVAC systems do not have such an input for controlling the make-up air volume to a single room. In this case, the control device 40 is usually in the form of a damper in the make-up air ducting, although in some cases the control may be implemented by a blower or fan. Damper 40 is preferably of the pressure-independent type so that the make-up air volume is not affected by variations in the pressure in ducting 38 upstream of the damper 40 which will occur during the normal operation of the HVAC system. Depending on the parameters of the fume hood, the fume hood room, and the HVAC system, a linearizing circuit 52 may also be required between the output of make-up air controller 32 and the damper 40, as discussed below.

In general, the relationship between the airflow out of a damper and the command applied to the damper is a complex function which is not linear over the entire range of the damper. In some situations, this will additionally require the use of a linearizing circuit 52 between the output of make-up air controller 32 and the damper 40.

Whether or not a linearizing circuit is necessary will depend upon the individual requirements of a particular installation. For example, in the case of a single fume hood located in a large laboratory, the minimum volume of make-up air normally supplied to ventilate the room may be 2,000 CFM. The air which is normally supplied by the make-up air system and which does not go out through the fume hood is recirculated or exhausted by the HVAC system for ventilation and for heating or cooling the room. Assume the fume hood exhaust volume will vary between 200 and 1,000 CFM. To maintain a differential of 200 CFM, for example, between the make-up air and the total volume of air exhausted by the fume hood and the HVAC system as the sash is moved from the lowest to highest position, the make-up air volume must vary from 2,000 CFM to 2,800 CFM. This is a variation of approximately 35% of the total air flow, and a damper may well have a transfer function which is sufficient linear over a range of 35% so that the linearizing circuit 52 is not needed. If the same hood is used in a smaller laboratory which has a normal make-up air requirement of 500 CFM, the damper must vary the make-up air volume from 300 to 1,100 CFM, or a variation of approximately 4 to 1. In such cases, it may be necessary to include a circuit 52 to provide a linear relationship between the output signal from make-up air controller 32 and the air flow through the damper.

Many different circuits are known for implementing a transfer function to correct the non-linear characteristics of the damper. For example a National Semiconductor LM3914 integrated circuit may be used to implement linearizing circuit 52, as described in more detail in the above-referenced U.S. Pat. No. 4,528,898. The particular transfer function required from linearizing circuit 52 will depend on the particular damper used as well as the range over which the air flow is varied, and selecting the appropriate function and linearizing circuit is well within the capabilities of one of ordinary skill in the art.

Figure 2:
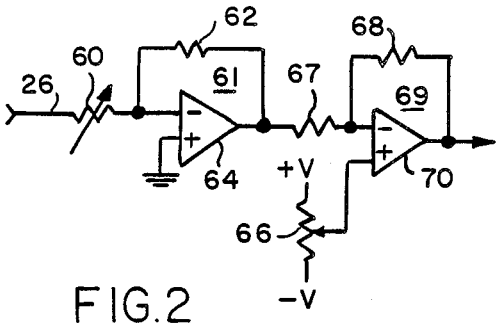
FIG. 2 shows one circuit for implementing the make-up air controller shown in FIG. 1.

FIG. 2 shows one manner in which the make-up air control circuit may be implemented. The signal on line 26 from the sash height transducer is applied via a variable resistor 60 to the inverting input of an amplifier stage made up of op-amp 64. The output of op-amp 64 is fed back to the inverting input via a fixed resistor 62. The non-inverting input to the op-amp is grounded. By varying the value of resistor 60, the gain of amplifier stage 61, and hence the scale factor, may be changed. The output from amplifier stage 61 is applied to a unity gain amplifier stage 69 made up of op-amp 70 and resistors 67 and 68. The non-inverting input to op-amp 70 is connected to the wiper of a potentiometer 66 connected between positive and negative voltage sources. The voltage at the wiper of potentiometer 66 is effectively subtracted from the scaled input to amplifier 69, and by changing the setting of potentiometer 66, the desired offset may be selected. Both negative and positive offsets may be selected so that both negative and positive laboratory pressures may be achieved. A positive pressure may be desirable, as discussed above, in situations where it is desired to keep contaminants out of the laboratory.

By changing the value of variable resistor 60, the gain through the op-amp amplifier stage may be changed to select a desired scaling factor. Potentiometer 66 selects an offset voltage which is effectively subtracted from the op-amp output signal. Thus, the output of the circuit of FIG. 2 will be $(S \times V) - O$, where S is the scaling factor or gain of the amplifier stage determined by the value of resistor 60, O is the offset voltage added to the op-amp output signal, and V is the input voltage applied to line 26.

It should be appreciated that while the preferred embodiment is described herein as using electronic circuitry, it will be apparent to those of ordinary skill in the art how other types of control systems, such as pneumatic systems, may be used to implement the various functions which must be performed to practice the present invention, and the present invention should not be construed as being limited to implementations using electronic circuitry.

When flow control 30 is implemented by means of a blower motor controller of the type described in the aforementioned U.S. Pat. No. 4,528,898, or to any other type of linear flow control device such as a linearized damper, the relationship between the input and output of the flow controller is linear during normal operation, and in such circumstances, the input to the make-up air controller 32 may be taken from the output of flow control circuit 30, as indicated by dotted line 54, instead of from the transducer output. It is preferable, however, to take the input to controller 32 from a source that represents the sash height, such as the sash transducer output for several reasons. First, it is common to have an emergency mode for the fume hood fan which causes the fan to operate at top speed, independent of the sash position. This mode would normally be used in case of a fire or other situation in the fume hood or the laboratory which requires immediate exhausting of the maximum amount of air. In such situations, it is not desirable for the make-up air to increase, since the negative pressure of the laboratory should be increased to contain the fumes; and thus taking the make-up air controller input from the flow control output is less desirable than taking the input from the sash sensor. (A circuit for further improving the operation of the present invention in such circumstances is described below in connection with FIG. 3.)

Second, in normal operation, the settings of flow control circuit 30 may be periodically adjusted to maintain a fixed face velocity. These adjustments may be necessary to correct changes in the exhaust flow volume caused by changes in the duct work, gradual clogging of filters, changes in the amount of air seeping into a room through cracks, and other unavoidable changes in the building and HVAC system. It is normally desired to have a fixed offset between the make-up air volume and the fume hood exhaust volume. By taking the input to the make-up air controller from the transducer, adjustments to the flow controller to return the fume hood face velocity and air flow to original specifications may be done without requiring further changes to the make-up air controller scale factor or offset inputs.

Figure 6:
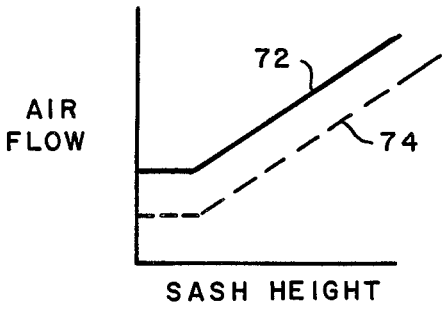
FIG. 6 is a graph helpful in explaining an alternate embodiment of the present invention.

Due to the fact that non-linearities at low exhaust flows are more likely to result in dangerous reverse flow out of the hood, some flow controllers modify the desired linear relationship between sash opening area and air flow for small sash openings. See, for example, the previously referenced U.S. Pat. No. 4,528,898 which describes a flow controller which produces a flow versus sash height curve such as that illustrated by line 72 in the graph shown in FIG. 6. In such cases, the present invention as described above will function acceptably, since the fume hood exhaust volume, and hence the difference between the linear relationship and that shown by curve 72, are small. However, the performance of the present system may be improved somewhat by taking the input to the make-up air controller 32 from a point in the flow controller circuitry following the circuitry which flattens the curve at low flows. In this case, the flow versus sash height curve of the make-up air would be as shown by dashed line 74 in FIG. 6. It can be seen that the desired constant difference between exhaust and make-up flow volumes is maintained throughout the range of fume hood operation.

Figure 3:
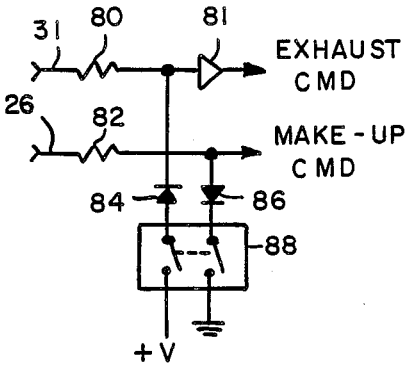
FIG. 3 shows an emergency ventilation circuit for use with the present invention.

FIG. 3 shows a circuit for allowing an emergency mode of operation in which the air is cleared from the fume hood and laboratory as quickly as possible. The line 31 from the blower flow controller to the blower is opened at point 90 in FIG. 1 and series-connected resistor and buffer/driver stage 81 are inserted. The line 26 to make-up air controller 32 is broken at point 92, and replaced with resistor 82. A DPST switch 88 selects emergency mode and may be manually or automatically activated. One half of switch 68 connects the junction of resistor 80 and buffer 81 to a positive voltage source through diode 84. The second half of switch 88 connects the input to make-up air controller 32 to ground through diode 86. When switch 88 is activated, the input to the blower motor is forced high driving the blower at maximum speed, and the input to the make-up air controller is forced to ground, causing the make-up air supply to provide the minimum air supply. Consequently, the fume hood exhaust keeps the laboratory at the maximum negative pressure.

Figure 4:
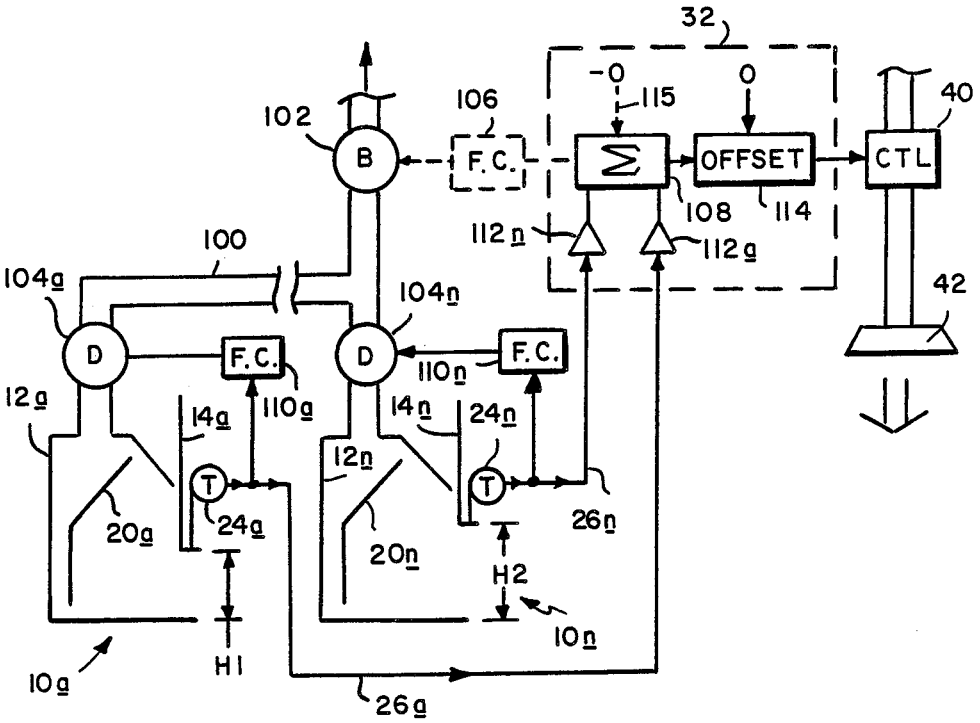
FIG. 4 shows the present invention as it would be used with a multiple fume hood installation.

FIG. 4 shows an embodiment of the present invention for use with a multiple fume hood system. In FIG. 4 a plurality of hoods represented by hoods **10*a* and 10*n* are shown as being connected to common exhaust ducting 100. The system described below is equally applicable to a laboratory having two or more fume hoods or fume hood systems whose exhaust ducting is not connected. Each hood has an associated transducer 24 the output of which represents the height of the associated sash. The outputs from the sash height transducer may be used to control the total exhaust flow by being summed in summer circuit 108 and applied through a flow controller 106 to a single blower or damper, as described in detail in the above referenced U.S. Pat. No. 4,528,898, or by individually being applied to dampers associated with each hood through respective flow controllers 110**, as described in the above referenced U.S. Pat. No. 4,706,553.

In either case, the make up air control is preferably provided in the following manner. The individual outputs on lines 26 from transducers 24 are applied to a summing circuit 108 through scaling circuits 112. Scaling circuits 112 serve to provide a scale factor correction in the same manner as described above for scaling circuit 48 in FIG. 1. This will also include corrections for hoods of different sizes which will provide different flows for the same sash heights. The output from summing circuit 108 represents the combined exhaust air volume through all of the fume hoods **10*a* through 10*n***.

After summing, an offset signal is subtracted from the summer output signal by offset circuit 114. The output of the offset circuit is applied to control the total make-up air into the laboratory, as described above in connection with FIG. 1.

Alternately, the offset signal can be applied with a negative polarity to summing circuit 108, obviating the need for a separate offset circuit 114. This is illustrated in FIG. 4 by the negative offset signal 115 applied to summing circuit 108.

Some buildings do not have means to provide individual control of the air flow into the fume hood room or rooms. In this case, it is necessary to control the total fresh air intake entering the building, or that part of the building including the laboratory rooms, so it varies in accordance with the total exhaust volume. In this case, an offset between the building total fresh air intake and exhaust may be needed to provide either a slight negative or positive building pressure. In such cases, the implementation discussed above in connection with FIG. 4 may be used to sum the make-up air commands from all the hoods in the building to produce a total fresh air intake command signal. An offset may be added as discussed above to maintain a fixed pressure differential between the building and the outside and, if necessary, to account for fixed volume building exhausts, such as toilet or kitchen exhausts.

Figure 5:
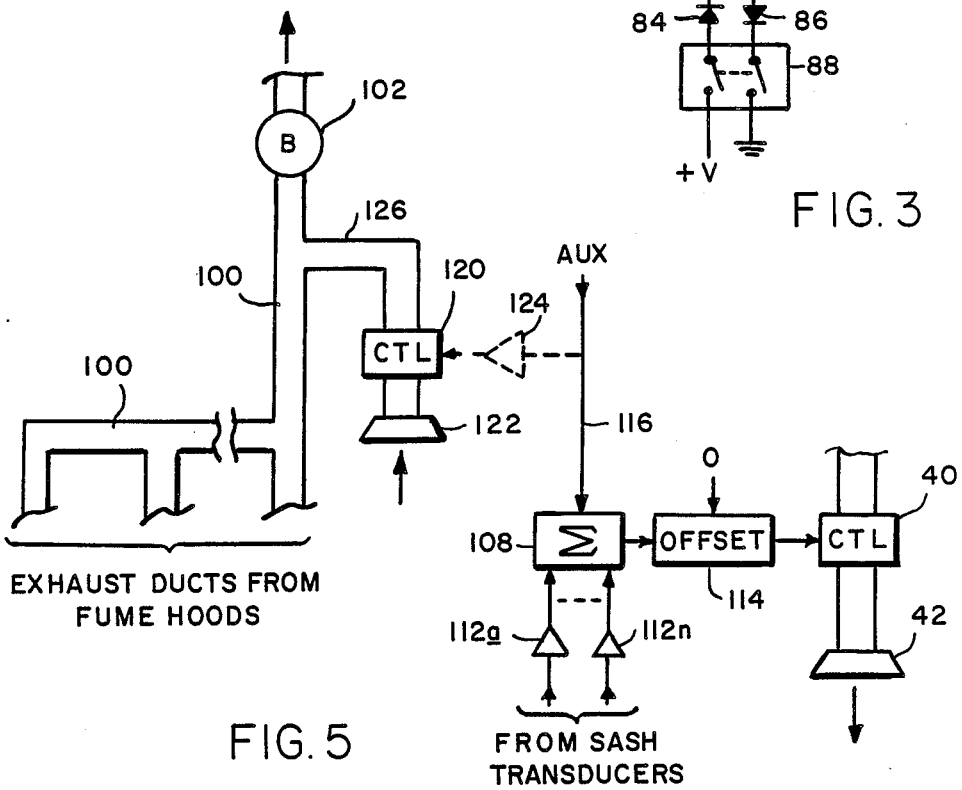
FIG. 5 shows the present invention used with a fume hood system wherein the make-up and exhaust air can be increased to provide increased heating and cooling in the indicated space or room.

Some HVAC systems control the temperature of individual rooms or areas by varying the amount of heated or cooled air introduced into the room by the HVAC system. In such systems, it may be necessary to increase the volume of make-up air to control the temperature. FIG. 5 illustrates an embodiment of the present invention for use with such a system. FIG. 5 illustrates part of a multiple hood system similar to that shown in FIG. 4.

In FIG. 5, a plurality of hoods, not shown, exhaust into one or more exhaust ducts, represented by common exhaust duct 100 in FIG. 5. The sash transducer signals are applied to a summing circuit 108 through scaling circuits 112, as previously described. The output from offset circuit 114 is applied to control 40 to control the volume of make-up air. An additional input 114 labeled AUX in FIG. 5 is applied to summing circuit 108 and summed with the sash height signals from the sash transducers. The AUX signal represents the increased HVAC system air flow necessary to provide proper temperature control. Thus the total make-up air is controlled to be equal to the sum of the hood exhausts plus the increased make-up air required for temperature control less the desired offset. The increase in the exhaust volume from the laboratory may be accomplished by the HVAC return air system. Alternatively, the fume hood exhaust system may be used to exhaust the increased air flow in the following manner.

A separate duct is taken from the common exhaust duct 100. Air is exhausted from the laboratory through an intake 122 via a linear control 120, such as a linearized damper or a blower, into duct 126. The AUX signal is be applied, through a scaling circuit 124, if necessary, to control 120. As the AUX signal changes to indicate the need for increased make-up air for temperature control, the total air flow through the laboratory is increased.

It may happen that the total fume hood exhaust is so large that the make-up air system is supplying too much air and overheating or cooling the room. Typically, this will occur when the make-up air system provides too much cooled air into a room in response to large volumes of air being exhausted by the hoods. In this situation, the make-up air can be heated slightly such as by terminal reheating. The heating is then controlled by a separate system having its own thermostat and controls. Auxiliary cooling can also be added if necessary to compensating for overheating.

For situations where only a small increase in the make-up air volume is required, it is possible to merely increase the volume of air exhausted through the hoods, instead of adding the extra ducting 126, control 120 and intake 122. It should be clear that this technique is limited to small increases in make-up air flow volume, otherwise, the face velocities of the fume hoods will exceed safe values.

There has been described a novel method and apparatus for controlling the make-up air volume in a building having one or more fume hoods. It should be appreciated that the preferred embodiments described herein will be modified by those of ordinary skill in the art in implementing the present invention and applying teachings of this application to different situations. Accordingly, the present invention should not be taken as being limited by the described embodiments, but rather the invention should be construed in accordance with the scope of the following claims.

What is claimed is:

1. Apparatus for controlling the volume of make-up air supplied to an area in which is located a fume hood having an exhaust volume which varies as the fume hood sash is opened and closed comprising:

transducer means, responsive to the fume hood sash position, for providing an output signal representative of the area of the sash opening;

make-up air control means, connected to an air supply and responsive to a make-up air command signal, for providing a make-up air flow the volume of which is determined by the make-up air command signal, and a make-up air controller for providing the make-up air command signal, including:

means for multiplying the transducer means output signal by a scale factor to provide a scaled output signal;

offset means, responsive to the scaled output signal, for subtracting therefrom a signal representative of a desired air flow volume differential between the fume hood exhaust volume and the make-up air volume to provide an output signal representative of a resulting make-up air volume; and means, responsive to the offset means output signal, for applying a make-up air command signal to the make-up air control means so as to produce a make-up air flow the volume of which equals said resulting make-up air volume.

* * * * *